United States Patent [19]

Nohira et al.

[11] 4,096,691

[45] * Jun. 27, 1978

[54] CATALYST CONTAINER FOR USE IN EXHAUST MANIFOLD

[75] Inventors: Hidetaka Nohira; Hironori Bessho; Yasuyuki Sakai, all of Susono, Japan

[73] Assignee: Toyota Jidosha Kogyo Kabushiki Kaisha, Toyota, Japan

[ * ] Notice: The portion of the term of this patent subsequent to Feb. 1, 1994, has been disclaimed.

[21] Appl. No.: 704,509

[22] Filed: Jul. 12, 1976

Related U.S. Application Data

[63] Continuation-in-part of Ser. No. 645,783, Dec. 31, 1975, abandoned.

[30] Foreign Application Priority Data

Jun. 4, 1975 Japan ..... 50-66402
Sep. 26, 1975 Japan ..... 50-130998[U]

[51] Int. Cl.[2] ..... F01N 3/15
[52] U.S. Cl. ..... 60/295; 60/302
[58] Field of Search ..... 60/302, 299, 295; 23/288 FR

[56] References Cited

U.S. PATENT DOCUMENTS

| | | | |
|---|---|---|---|
| 3,685,972 | 8/1972 | Palma | 60/299 |
| 3,853,483 | 12/1974 | Cross | 60/301 |
| 3,968,645 | 7/1976 | Noguchi | 60/302 |
| 3,994,130 | 11/1976 | Sakai | 60/302 |
| 4,005,576 | 2/1977 | Nohira | 60/302 |

*Primary Examiner*—Douglas Hart
*Attorney, Agent, or Firm*—Stevens, Davis, Miller & Mosher

[57] ABSTRACT

A catalyst container for use in an exhaust manifold, which container includes perforated inner and outer cylinders and is positioned within the exhaust manifold, in the position of its exit, with catalysts filled in a cylindrical space defined between the inner cylinder and outer cylinder. In this catalyst container, annular openings in the cylindrical space at its top and bottom ends are covered with annular upper and lower lids, respectively, while a circular, inner cylinder lid is placed over the top opening of the inner cylinder to cover it. In addition, an outer cylinder lid is placed on the top circumferential edge of the outer cylinder in a manner to cover the top opening of the outer cylinder as well as the circular, inner cylinder lid. The catalysts are filled in a first space defined by the inner cylinder lid and the outer cylinder lid as well as in a second space defined between the outer cylinder and the inner cylinder. The first space communicates with the second space through at least one hole provided in the upper annular lid.

5 Claims, 5 Drawing Figures

CATALYST CONTAINER FOR USE IN EXHAUST MANIFOLD

This application is a continuation-in-part of our copending application Ser. No. 645,783 filed on Dec. 31, 1975 now abondoned.

BACKGROUND OF THE INVENTION

1. Field of the invention

This invention relates to a catalyst container for use in an exhaust manifold, and more particularly to a cylindrical catalyst container comprising of perforated inner cylinder and outer cylinder, thus providing a double wall construction, with catalysts filled in a space defined between the inner cylinder and outer cylinder.

2. Description of the prior art

It is known to use catalysts for reducing the quantity of harmful gases contained in exhaust gases, such as carbon monoxide (CO), hydrocarbon (HC) and nitrogen oxide (NOx). A catalyst device or converter containing catalysts is placed within an exhaust pipe, but in a location which is a considerable distance from the exhaust port of an internal combustion engine for the purpose of preventing excessive consumption of catalysts.

Catalysts perform at high efficiency when used at a relatively high temperature. Unfortunately, the service life of the catalysts is shortened at these high temperatures. In addition, the service life of catalysts is shorter than those of other parts used in the motor vehicle, making it necessary that the catalyst device be checked or replaced periodically. The arrangement of the prior art catalyst devices is not suited for such requirements.

SUMMARY OF THE INVENTION

It is an object of the present invention to provide a catalyst container for use in an exhaust manifold which may be installed in a position suited for performing at high catalytic efficiency and which reduces the frequency of maintainance.

It is another object of the present invention to provide a catalyst container of the type described, which permits ready maintenance and replacement.

It is further object of the present invention to provide a catalyst container of the type described, which accommodates itself to thermal expansion of the catalysts, which are subjected to a high temperature, as well as to the thermal expansion of the container itself in its axial direction.

It is a still further object of the present invention to provide a catalyst container of the type described, which permits ready supply of catalysts into the container.

According to the present invention, there is provided a catalyst container for use in an exhaust manifold of the type having perforated inner and outer cylinders, with catalysts filling in a cylindrical space defined between the inner and outer cylinders, said container comprising: upper and lower annular lids closing the top and bottom openings of the cylindrical space defined between the inner and outer cylinders; a circular lid covering the top opening of the inner cylinder; an outer cylinder lid placed on the top circumferential edge of the outer cylinder in a manner to cover the top opening of the outer cylinder as well as the aforesaid circular, inner cylinder lid of the inner cylinder; whereby there are defined a first space between the outer cylinder lid and the circular, inner cylinder and a second space between the inner and outer cylinders, said first space communicating with the second space through at least one hole provided in the upper annular lid. In this respect, catalysts are placed not only in the first space but also in the second space, so that when catalyst contained in the second space is consumed due to exhaust gases passing there-through, the catalysts contained in the first space will be automatically supplied to the second space for supplementing the consumed catalysts in the second space. The catalysts contained in the first space are not consumed, because of the absence of the flow of exhaust gases.

According to another aspect of the catalyst container of the invention, there are provided, on the walls of the inner and outer cylinders, a plurality of rows of embossed portions extending in the axial direction of the cylinders, in such a manner that the embossed portions are spaced a given distance apart in the axial direction, with the rows in parallel relation to each other as viewed in the circumferential direction of the cylinders. In addition, each of the embossed portions has slits on its opposite sides as viewed in the circumferential direction of the cylinders, thus presenting bridge-shaped, built-up portions on the outer circumferential surfaces of the cylinders. Those embossed portions or bridge portions may absorb the stresses created in the walls of the cylinders due to thermal expansion of catalysts, particularly in the radial direction of the cylinders.

According to a further aspect of the catalyst container of the present invention, the outer cylinder lid, which covers the top opening of the outer cylinder, forms a wall of the exhaust manifold, and in addition the lower end of the inner cylinder provides a tubular joint which is adapted to be fitted in to an exit of the exhaust manifold to form a gas-tight connection, thus permitting ready attachment and removal of the catalyst container in or from the exhaust manifold. In addition, the outer cylinder lid is adapted to cover the top opening of the exhaust manifold, through which opening the catalyst container is installed in the exhaust manifold. The catalyst container is positioned directly on the exist of the exhaust manifold, presenting high catalytic efficiency as well as permitting ready maintenance and replacement.

According to a still further aspect of the present invention, the container is so designed as to be installed in the exhaust manifold, with a certain clearance left between the bottom end of the outer cylinder and the adjacent inner bottom wall of the exhaust manifold, thus permitting free thermal expansion of the outer cylinder in the axial direction thereof.

According to a further aspect of the present invention, the outer cover portion of the outer cylinder lid is formed with a cavity having a threaded wall which is adapted to mesh with the threaded surface formed on the cylindrical portion that projects from the annular lid portion covering the top opening of the outer cylinder. With this construction by removing the outer cover portion, catalysts may be supplied through the aforesaid cylindrical portion into the first space in the outer cylinder.

DESCRIPTION OF THE PREFERRED EMBODIMENTS

Figure 1:
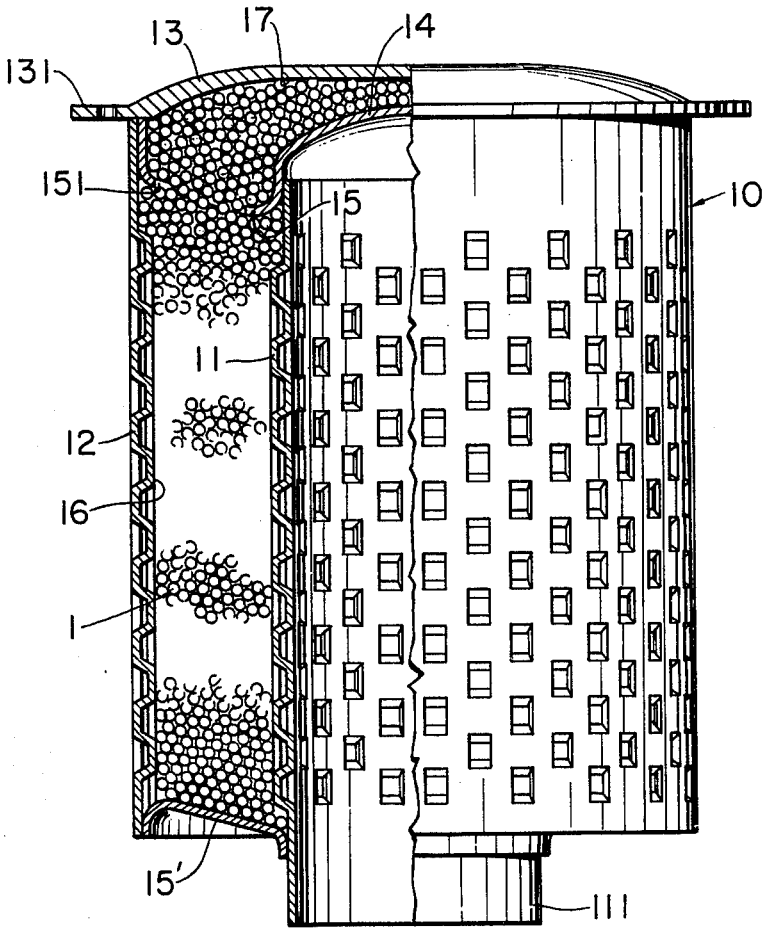
FIG. 1 is a partial, vertical cross-sectional view of one embodiment of the cylindrical catalyst container for use in an exhaust manifold according to the present invention.

Referring now to FIG. 1, there is shown a cylindrical catalyst container 10. The catalyst container 10 essentially includes a perforated inner cylinder 11 and a perforated outer cylinder 12. Catalysts 1 are contained in cylindrical space 16 (the "second space"), defined between the inner cylinder 11 and outer cylinder 12. In addition, upper and lower annular lids 15 and 15' are placed on the axially opposite ends of cylindrical space 16, respectively. Provided at the top end of the inner cylinder 11 is an inner cylinder lid 14 to cover the top opening thereof. In this respect, the inner cylinder lid 14 may be integral with the upper annular lid 15. An outer cylinder lid 13 is placed so as to cover the upper annular lid 15 as well as the inner cylinder lid 14. The upper edge of outer cylinder 12 projects upward beyond the upper edge of the inner cylinder 11 in the axial direction, so that there is a space 17 (the "first space"), defined by the outer cylinder lid 13, inner cylinder lid 14 and upper annular lid 15. The upper annular lid 15 has at least one hole 151 therein, through which the space 17 communicates with the space 16. The lower edge of the inner cylinder 11 projects downward beyond the lower edge of the outer cylinder 12, while the lower projection portion of the inner cylinder 11 serves as a tubular joint portion 111 for the exist of an exhaust manifold.

The circumferential edge of the outer cylinder lid 13 projects outwardly from the wall of the outer cylinder 12 in the radial direction. The projecting circumferential edge of the outer cylinder lid 13 provides an attaching flange 131 which is to be placed over the circumferential edge of an opening in the exhaust manifold, through which opening the catalyst container is to be installed therein. Thus, when the catalyst container is installed, the outer cylinder lid 13 constitutes part of the wall of the exhaust manifold.

The inner cylinder 11 and outer cylinder 12, and lids 13, 14, 15, and 15' are welded together so as to provide a gas-tight enclosure.

Provided in the walls of the inner cylinder 11 and outer cylinder 12 are a plurality of axially extending rows of embossed portions each having slits on its opposite edges as viewed in the circumferential direction. Thus, the rows are parallel to each other in the circumferential direction. The embossed portions project into the second space 16, i.e., the cylindrical space defined between the inner and outer cylinders 11 and 12, respectively. The slits thus defined are directed in the circumferential direction of the respective cylinders 11 and 12.

When a cylindrical catalyst container is installed in an exhaust manifold, the outer cylinder 12 may contact exhaust gases flowing into the exhaust manifold, while the tubular joint portion 111 of the inner cylinder is fitted in the exit of the exhaust manifold in gas tight relation. Thus, exhaust gases introduced into the exhaust manifold are then introduced through the outer cylinder 12, catalyst 1, inner cylinder 11 and tubular joint portion 111 into an exhaust pipe, not shown.

Catalysts are also placed in the space 17, where exhaust gases are not introduced, so that the catalysts contained there are not consumed. On the other hand, the catalysts contained in the space 16 decrease in volume due to catalytic reaction with the exhaust gases. However, catalysts contained in the space 17 supplement the catalysts in space 16, so that the space 17 is used as a catalyst supply source.

Figure 2:
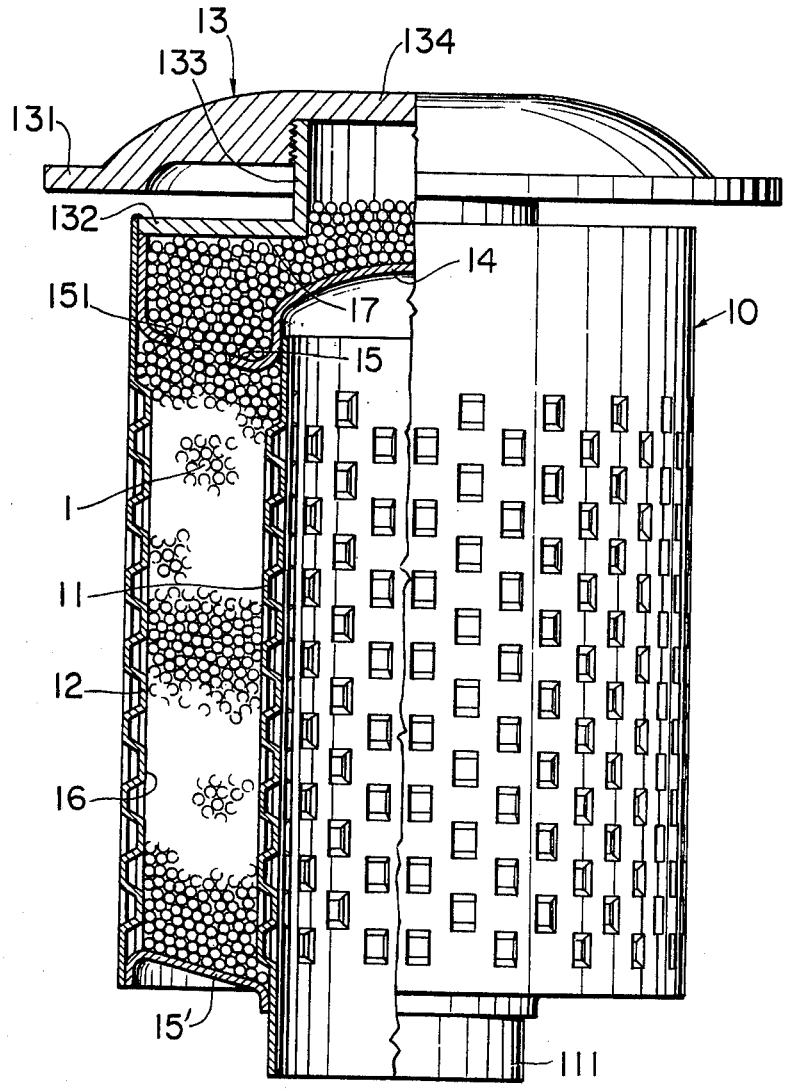
FIG. 2 is a partial, vertical cross-sectional view of another embodiment of the catalyst container for use in an exhaust manifold according to the present invention.

Referring to FIG. 2, which shows another embodiment of the catalyst container, there is shown a modified outer cylinder lid 13. The outer cylinder lid 13 includes an annular portion 132, cylindrical portion 133 and outer cover portion 134. The annular portion 132 is welded to the top edge of the annular lid 15 and/or the top edge of the outer cylinder 12. Annular portion 132 is also welded to cylindrical portion 133. Annular portion 132 may also be formed integrally with cylindrical portion 133. Outer cover 134 has a central threaded cavity, while the outer surface of the cylindrical portion 133 is threaded, so that outer cover 134 may be threadedly engaged with the cylindrical portion 133. Thus, the outer cover portion 134 may be removed from the cylindrical portion 133 when catalysts are to be placed in the first space 17. In addition, due to the threaded engagement described above, the total length of the cylindrical catalyst container may be adjusted to any desired height.

Figure 3:
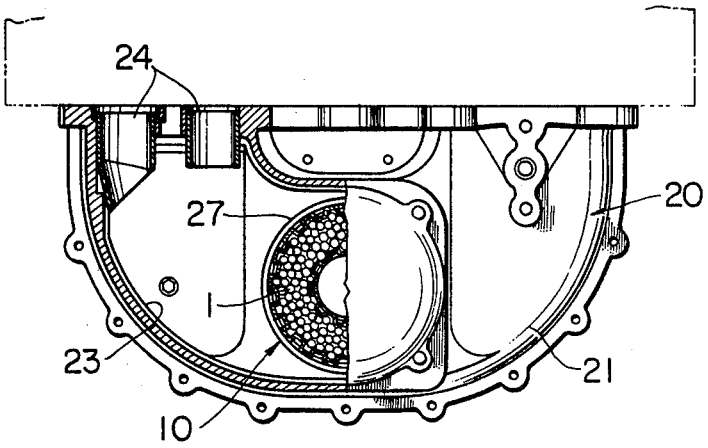
FIG. 3 is a partial, horizontal cross-sectional view of the catalyst container and exhaust manifold according to the present invention.
Figure 4:
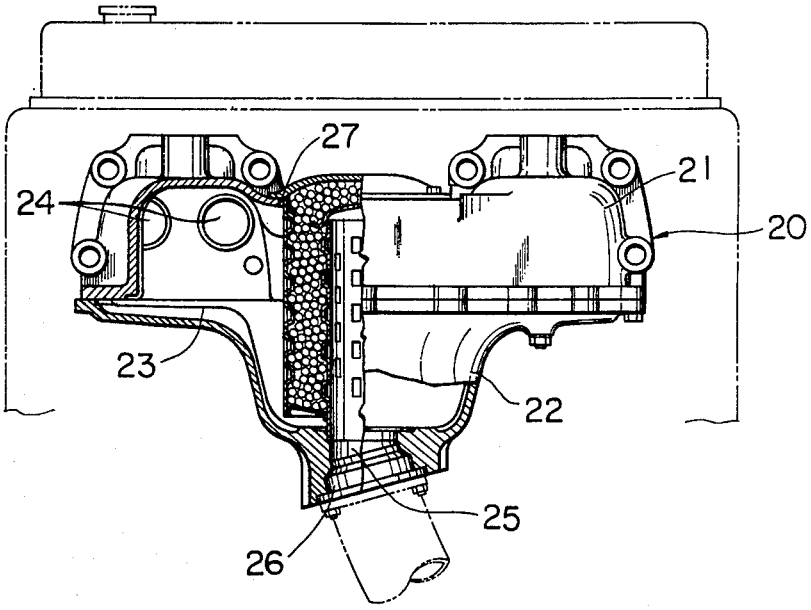
FIG. 4 is a partial, vertical cross-sectional view of the catalyst container and exhaust manifold according to the invention.

FIGS. 3 and 4 show the exhaust manifold 20 which houses the cylindrical catalyst container described above. Exhaust manifold 20 includes an upper half 21 and a lower half 22, both of which are coupled together by means of threaded portions. In general, the exhaust manifold has a plurality of entrances and one exit. The exhaust manifold 20 as shown has a substantially "U" shaped passage as viewed in the horizontal direction. The entrances of the manifold are shown at 24, which cover two exhaust ports in the cylinder head of an internal combustion engine, where the exhaust manifold 20 is attached to the cylinder head.

An exit 25 of the exhaust manifold 20 is positioned in the mid portion of the latter, while the catalyst container is positioned directly on the exit 25, extending in a vertical direction. In addition, exit 25 is directed toward the exhaust pipe 26 to be joined thereto.

In the wall of the exhaust manifold 20 opposite exit 25, there is provided a circular opening 27, whose diameter is slightly larger than the diameter of the outer cylinder 12 of the cylindrical catalyst container 10. The distance between the edge of the opening 27 and the bottom wall of the manifold is substantially the same as the distance of the edge of the flange portion 131 of the outer cylinder lid 13 and the lower end of the outer cylinder 12, thus providing a given clearance between the bottom wall of the manifold and the lower end of the outer cylinder 12. The clearance accommodates itself to the axial thermal expansion of the catalyst container. The diameter of the exit 25 of the exhaust manifold 20 is the same as the outer diameter of the tubular joint portion 111. As is clear from this description, the joint portion 111 may be removably fitted in the exit 25 of the exhaust manifold 20 in a gas tight relation.

In addition, the respective halves 21 and 22 of exhaust manifold 20 are provided with heat insulating liners which are spaced a desired distance from the inner wall of the manifold, respectively. When assembled, those liners may be fastened to the upper and lower halves of the manifold, thus presenting a double walled construction. Those liners are made of heat resistant steel.

Figure 5:
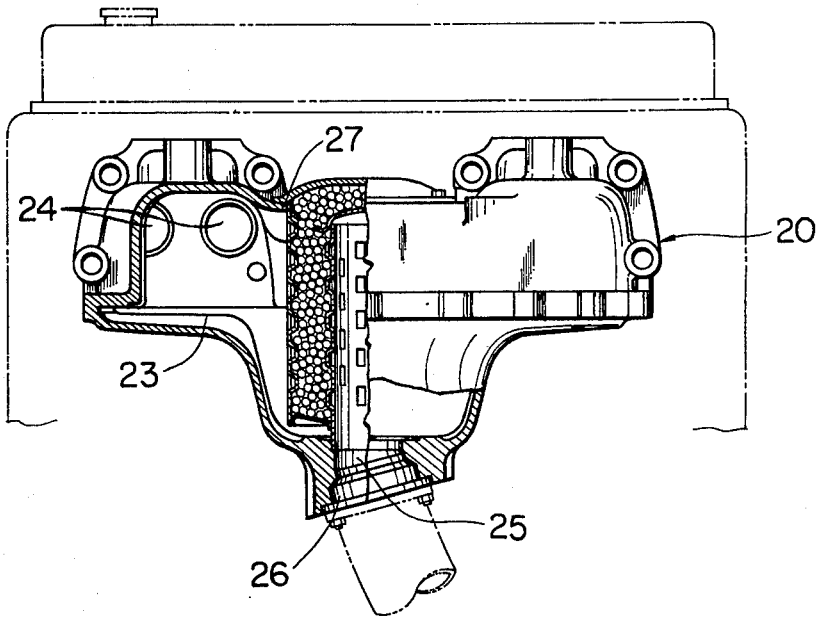
FIG. 5 is a partial, vertical cross sectional view of the catalyst container and exhaust manifold which is modified, according to the present invention.

Referring to FIG. 5, there is shown an exahust manifold 20 having an integral wall construction, in which an upper half and a lower half of the manifold are formed integrally. This modification facilitates the manufacture of the exhaust manifold and hence its required future maintenance, with the accompanying saving in manufacture and maintenance costs.

It will be understood that the above description is merely illustrative of the preferred embodiments of the invention. Additional modifications and improvements falling within the scope of the present invention will be readily apparent to those skilled in the art from the present disclosure, the scope being limited only by that of the appended claims.

We claim:

1. A catalyst container, for use in an exhaust manifold, having perforated substantially vertically disposed inner and outer cylinders, with catalysts in a cylindrical space defined between said inner and outer cylinders, said container comprising:

upper and lower annular lids closing the top and bottom annular openings respectively of the cylindrical space defined between said inner and outer cylinders;

a circular inner cylinder lip covering the top opening of said inner cylinder;

an outer cylinder lid on the top circumferential edge of said outer cylinder covering the top opening of said outer cylinder and said circular inner cylinder lid, said outer cylinder lid including an annular portion, a cylindrical portion having a threaded outer circumferential surface, and an outer cover portion, means defining a cavity having a threaded wall in said outer cover portion, and said outer cover portion being removably threadedly fitted on said threaded outer circumferential surface of said cylindrical portion, said outer cylinder lid and said inner cylinder lid defining a first space therebetween; and means defining a hole in said upper annular lid through which the first space is communicated with the cylindrical space defined between the inner and outer cylinders.

2. An exhaust manifold of an internal combustion engine, said manifold including a wall, an exit, and a catalyst container in said exhaust manifold, said container comprising perforated, substantially vertically disposed inner and outer cylinders defining an annular cylindrical space between them, said container further comprising:

upper and lower annular lids fitting at opposite ends of said inner and outer cylinders to define between them an annular volume filled with a catalyst suitable for cleaning the engine exhaust;

a circular inner cylinder lid covering the top opening of said inner cylinder;

an outer cylinder lid on the top circumferential edge of said outer cylinder covering the top opening of said outer cylinder and said circular inner cylinder lid, said outer cylinder lid and said inner cylinder lid defining a first space between them;

means defining a hole in said upper annular lid through which the first space communicates with the annular volume defined between the inner and outer cylinders, said outer cylinder lid being part of the wall of the exhaust manifold; and the lower end of the inner cylinder comprising a tubular joint portion removably fitted in the exit of the exhaust manifold in gas tight relation.

3. An exhaust manifold of an internal combustion engine, said manifold including a top wall with an opening therein and a catalyst container in said exhaust manifold, said container comprising perforated substantially vertically disposed inner and outer cylinders defining an annular cylindrical space between them, said container further comprising:

upper and lower annular lids fitting at opposite ends of said inner and outer cylinders to define between them an annular volume filled with a catalyst suitable for cleaning the engine exhaust;

a circular inner cylinder lid covering the top opening of said inner cylinder;

an outer cylinder lid on the top circumferential edge of said outer cylinder covering the top opening of said outer cylinder and said circular inner cylinder lid, said outer cylinder lid and said inner cylinder lid defining a first space between them; and means defining a hole in said upper annular lid through which the first space communicates with the annular volume defined between the inner and outer cylinders, said catalyst container being positioned in said exhaust manifold through the opening in the top wall thereof, said outer cylinder lid covering said opening.

4. An exhaust manifold of an internal combustion engine, said manifold including an inner bottom wall, a top wall and a catalyst container in said exhaust manifold, said container comprising perforated, substantially vertically disposed inner and outer cylinders defining an annular cylindrical space between them, said container further comprising:

upper and lower annular lids fitting at opposite ends of said inner and outer cylinders to define between them an annular volume filled with a catalyst suitable for cleaning the engine exhaust;

a circular inner cylinder lid covering the top opening of said inner cylinders;

an outer cylinder lid on the top circumferential edge of said outer cylinder covering the top opening of said outer cylinder and said circular inner cylinder lid, said outer cylinder lid and said inner cylinder lid defining a first space between them; said outer cylinder lid being part of the top wall of the exhaust manifold; and means defining a hole in said upper annular lid through which the first space communicates with the annular volume defined between the inner and outer cylinders, the lower edge of said outer cylinder and the inner bottom wall of said exhaust manifold being spaced from each other to define a clearance therebetween.

5. A catalyst container as set forth in claim 1, wherein said exhaust manifold has an integral, unitary wall construction, having an upper half and a lower half which are inseparable from each other.

* * * * *